US007055610B2

(12) United States Patent
Vincent et al.

(10) Patent No.: US 7,055,610 B2
(45) Date of Patent: Jun. 6, 2006

(54) PLUG CONCEALMENT AND DIVERSION TOOL

(75) Inventors: Ray Vincent, Houston, TX (US); Dennis G. Jiral, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 189 days.

(21) Appl. No.: 10/457,973

(22) Filed: Jun. 9, 2003

(65) Prior Publication Data

US 2004/0040719 A1 Mar. 4, 2004

Related U.S. Application Data

(60) Provisional application No. 60/388,090, filed on Jun. 12, 2002.

(51) Int. Cl.
*E21B 33/13* (2006.01)

(52) U.S. Cl. ..... 166/386; 166/373; 166/177.4; 166/242.3; 166/320

(58) Field of Classification Search ..... 166/386, 166/117, 162, 177.4, 317–320, 242.3, 383, 166/373
See application file for complete search history.

(56) References Cited

U.S. PATENT DOCUMENTS 3,554,281 A * 1/1971 Ecuer ..... 166/155
3,789,926 A 2/1974 Henley et al.
4,260,017 A 4/1981 Nelson et al.
4,427,070 A 1/1984 O'Brien
4,512,398 A 4/1985 Hazel
4,646,839 A * 3/1987 Rickey ..... 166/335
5,099,919 A 3/1992 Schneider et al.
5,404,945 A 4/1995 Head et al.
5,673,751 A 10/1997 Head et al.
5,975,209 A * 11/1999 McCorry ..... 166/321
6,296,059 B1 10/2001 Leeb et al.

* cited by examiner

*Primary Examiner*—Kenneth Thompson
(74) *Attorney, Agent, or Firm*—Gerald W. Spinks

(57) ABSTRACT

A tool for capturing and retaining a pump down plug or ball which has been released from equipment above in a well bore, concealing the pump down plug from subsequent flow of fluid or other material through the tool, and diverting flow from a normal circulation port toward a bypass port through the tool. The pump down plug seats in, and closes, the circulation port, where the pump down plug is then retained by a tubular receptacle. Increased fluid pressure then shears the tool body loose from its housing, moving it downward to a position lower in the housing. This opens the path through which the pump down plug was released from above. A further pressure increase can be used to open the bypass port through the tool body. When the tool body is released from its first position, a diverter can close over the tubular receptacle and divert movement of fluid and other material away from the area of the circulation port and toward the bypass port.

14 Claims, 2 Drawing Sheets

PLUG CONCEALMENT AND DIVERSION TOOL

CROSS REFERENCE TO RELATED APPLICATIONS

This application relies upon U.S. Provisional Patent Application No. 60/388,090, filed Jun. 12, 2002, for "Plug Concealment and Diversion Tool".

STATEMENT REGARDING FEDERALLY SPONSORED RESEARCH OR DEVELOPMENT

Not Applicable

BACKGROUND OF THE INVENTION

1. Field of the Invention

The present invention is in the field of equipment which operates by means of closing a downhole port by pumping a plug, ball, or other device downhole with the drilling fluid, cement, or other fluid.

2. Background Art

It is well known in the art of oil and gas well drilling to operate or actuate downhole equipment by pumping a plug, ball, or other device downhole with the drilling fluid, cement, or other fluid. The term pumpdown plug, pumpable plug, or other such term, as used herein, is intended to include all such devices, whether plugs, balls, or other items.

When it is desired to actuate a piece of downhole equipment, such as a cementing valve, it is common to pump a plug downhole to close off, and sometimes seal, a port through which fluid is being circulated. The closing of this port can then be used to create an increased fluid pressure above the port, to actuate the device. After actuating the downhole equipment in this manner, it is sometimes desired to release the pumpable plug from the port and restore circulation through, the port. When a pumpable plug is released in this manner, it typically proceeds farther downhole. Unless such a released plug is properly captured and retained, it can interfere with, or even prevent, subsequent operations in the well bore below the location from which the plug was released.

It is known to capture such a released plug in a perforated tube below the downhole equipment which the plug was originally used to actuate. Capturing the released plug in a perforated tube has the advantage of allowing fluid flow through the perforations and to the well bore below the capture point. However, a perforated tube will not allow the performance of some subsequent operations which may be desirable, below the capture point, such as wireline operations. Further, if it is necessary to pass other equipment through the plug capture point in the well bore, such as for the purpose of undertaking remedial operations deeper in the well bore, the presence of the captured plug in the perforated tube will prevent such operations. In these situations, if the perforated tube is present, it would have to be removed before passing any equipment beyond the plug capture point.

It is desirable, therefore, to have a method and apparatus for capturing a pumpable plug which has been released, and for allowing the passage of fluid and equipment beyond the plug capture tool to a deeper location in the well bore.

BRIEF SUMMARY OF THE INVENTION

The present invention provides a method and apparatus for guiding a released plug to an open circulation port in a plug capture tool, thereby closing the circulation port. Increased fluid pressure above the plug capture tool then shears the tool body loose from its housing, allowing the tool body to move to a lower point in the housing where it comes to rest against a shoulder or some other retention feature. This removes the tool body from the inlet port through which the plug was released, allowing free flow or movement of fluid and other material through the open inlet port and past the captured plug, which is retained in place in the circulation port, by means such as a tubular plug guide. Further increasing the pressure can shear loose a closure plug which may be mounted in a bypass port in the tool body. Thereafter, fluid and other material which has passed through the inlet port and around the captured plug can move or flow through the bypass port to a location downhole from the tool body. When the tool body is sheared loosed from its attachment to its housing, and the tool body then moves farther downhole in the housing, this also allows a diverter means, such as a pivoting baffle, to move into place above the plug guide and above the captured plug. This baffle assists in retaining the captured plug in the plug guide. This baffle also diverts the flow or movement of fluid and other material, such as intervention or workover equipment, away from the area around the circulation port and toward the bypass port.

The novel features of this invention, as well as the invention itself, will be best understood from the attached drawings, taken along with the following description, in which similar reference characters refer to similar parts, and in which:

DETAILED DESCRIPTION OF THE INVENTION

Figure 1:
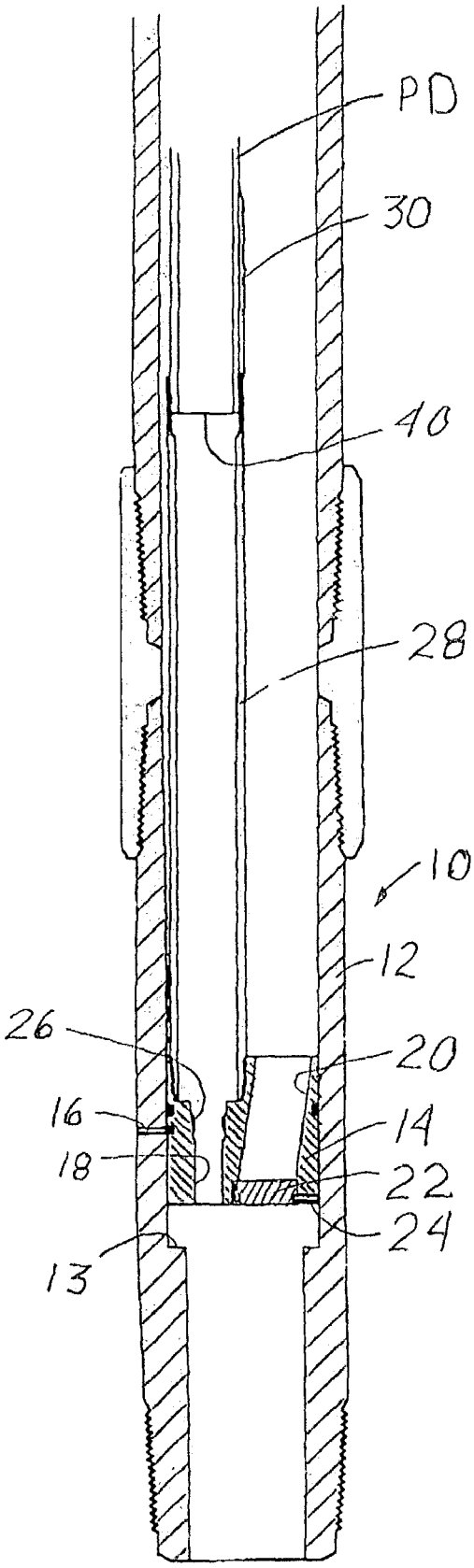
FIG. 1 is a longitudinal section view of the apparatus of the present invention, showing its connection to a production tube.

As shown in FIG. 1, the tool 10 of the present invention includes a tool housing 12, a slidable tool body 14, and a plug guide tube 28. The housing 12 can be mounted as part of a work string, below other equipment (not shown) which will ultimately release a pumpable plug or ball through a plug duct PD, such as a production tube. The tool body 14 is slidably mounted within the housing 12, and releasably held in a first position by a releasing device such as a tool body shear pin 16. It can be seen that this first position of the tool body 14 is a distance above an internal shoulder 13 within the housing 12.

A circulation port 18 is provided through the tool body 14, from above to below. A bypass port 20 is also provided through the tool body 14, from above to below. In the starting configuration, the bypass port 20 may be closed or plugged by a closure such as a shearable plug 22. Alternatively, the bypass port 20 may be open. When present, the shearable plug 22 can be held in place, for instance, by a bypass plug shear pin 24. A seat 26 can be provided in the throat of the circulation port 18.

A device for guiding a pumpdown plug or ball to the circulation port 18, such as a guide tube 28, can be attached to the tool body 14 above the circulation port 18, extending upwardly from the tool body 14. A material diverting means, such as a pivotable baffle 30 can be mounted to the upper end of the guide tube 28. As seen in the run-in configuration of the tool shown in FIG. 1, the upper end of the guide tube 28 is aligned with, and receiving, the lower end of the plug duct PD. In this configuration, a pumpdown plug which may be released from above will pass through the plug duct PD and out its lower end, which constitutes an inlet port 40 into the tool of the present invention, and into the plug guide tube 28. Rather than being at the outlet of a tubular element, such as a production tube, the inlet port 40 to the tool of the present invention could be found in any kind of equipment which might release a pumpdown plug or ball into the tool. In the configuration shown, where the tool is fed by a tubular element PD, the pivotable baffle 30 is necessarily pivoted away from the upper end of the guide tube 28, lying alongside the plug duct PD, to allow the lower end of the plug duct PD to communicate with the upper end of the guide tube 28. The pivotable baffle 30 can be biased by spring force, fluid flow, or gravity, as is known in the art, toward a position over the upper end of the guide tube 28.

Figure 2:
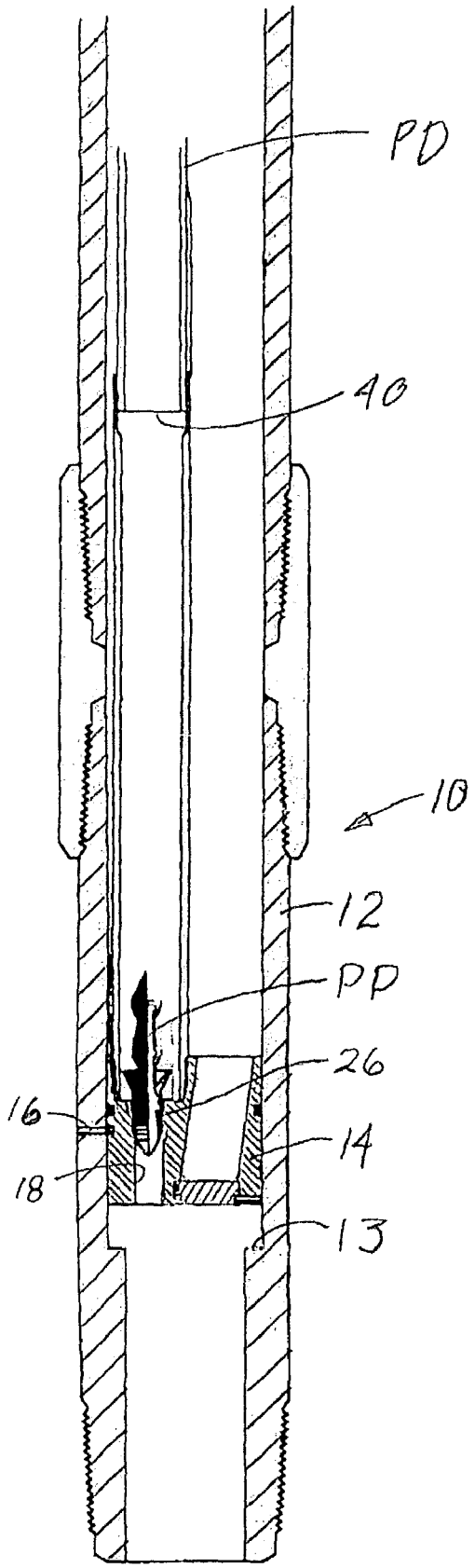
FIG. 2 is a longitudinal section view of the apparatus of FIG. 1, showing the landing of a pumpable plug released from above, through the production tube.

FIG. 2 shows the configuration of the tool when a pumpdown plug PP has been released from above to pass through the plug duct PD and the tool inlet port 40, into the guide tube 28. Having come to rest in the seat 26 of the circulation port 18, the pumpdown plug PP now stops flow of fluid and any other movement of any other material through the circulation port 18. In fact, where the bypass port 20 is plugged with a shearable plug 22, this prevents such movement of material past the tool body 14 in any way. Since the flow of fluid is stopped, this causes hydraulic pressure above the tool body 14 to increase, at the election of the operator. When the pressure above the tool body 14 is selectively raised to a sufficient level, the tool body shear pin 16 shears, and the tool body 14 slides downwardly relative to the housing 12, until it comes to rest against the housing shoulder 13, where it is retained against further downward movement. Alternatively, where the shearable plug 22 is not used, the operator can simply increase fluid flow through the bypass port 20 to a sufficiently high level to cause the differential pressure across the bypass port 20 to shear the shear pin 16.

Figure 3:
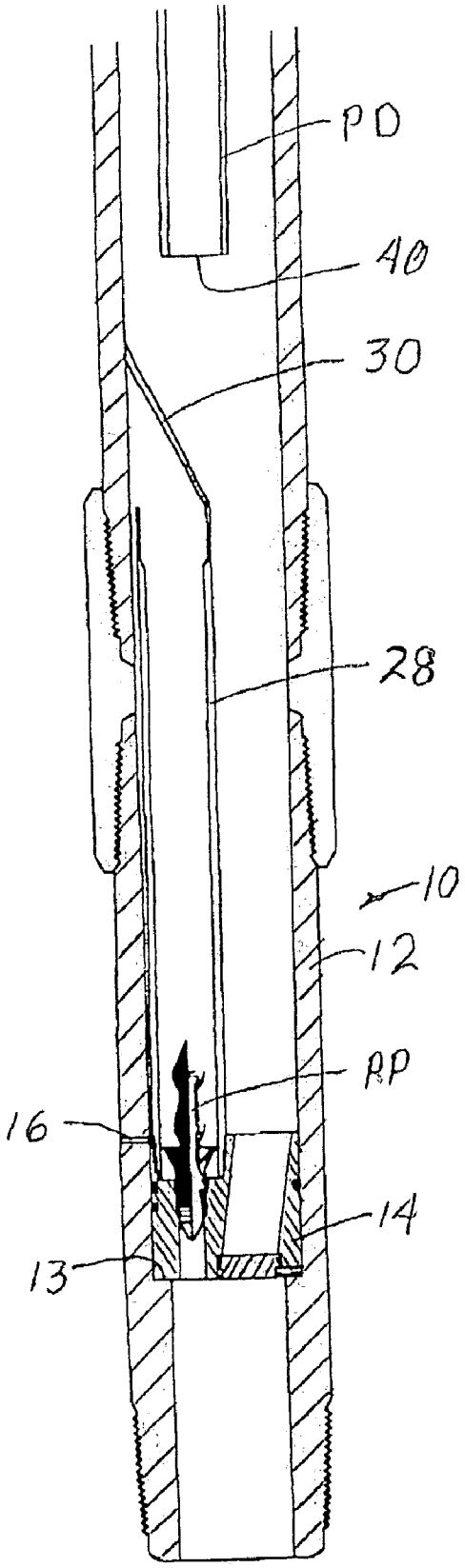
FIG. 3 is a longitudinal section view of the apparatus of FIG. 1, showing the tool body sheared from its attachment to the tool housing and showing the diverter baffle actuated.

In either case, the shifted position of the tool body 14 is shown in FIG. 3. It can be seen that, when the tool body 14 slides downwardly, the upper end of the guide tube 28 separates from the inlet port 40 and moves downwardly. This allows any additional material, whether fluid or solid, including equipment, to pass through the inlet port 40 and into the housing 12, without passing into the guide tube 28. Where the inlet port 40 is in the lower end of a tubular element such as the plug duct PD shown, the lower end of the tubular element may move laterally as shown, once free of the upper end of the guide tube 28.

Figure 4:
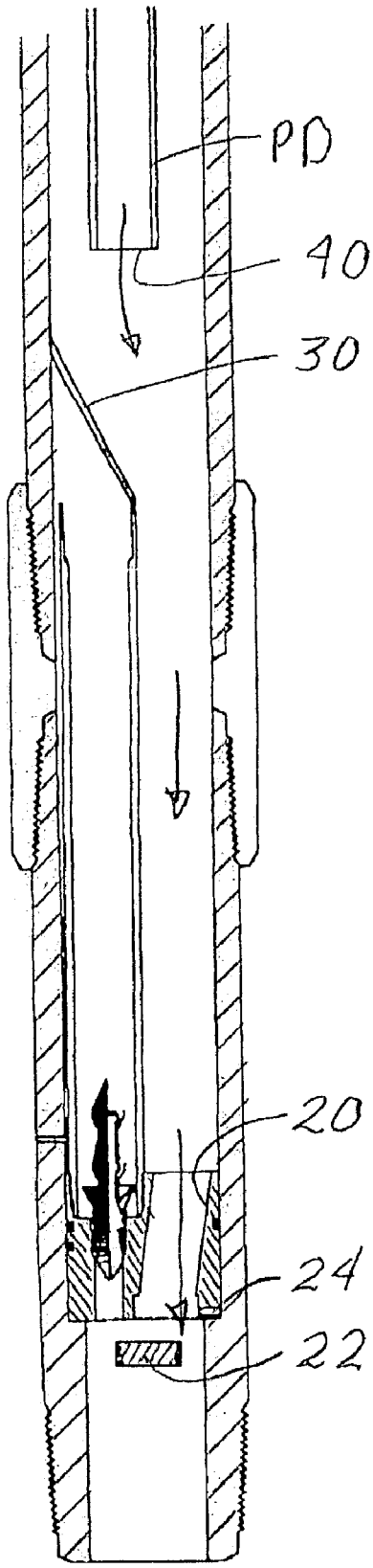
FIG. 4 is a longitudinal section view of the apparatus of FIG. 1, showing the closure plug sheared from its attachment to the tool body, within the bypass port.

When the tool body 14 and the guide tube 28 are selectively moved downwardly a sufficient amount, it can be seen that this allows the pivotable baffle 30 to pivot over the upper end of the guide tube 28. As mentioned above, the baffle 30 may be biased by spring force, fluid flow, or gravity to aid in this selective pivoting of the baffle 30. As can be seen, the baffle may also come to rest against the housing 12 or against other structure. When the baffle 30 pivots into the position above the upper end of the guide tube 28, it acts as a material diverter, diverting material which may pass through the inlet port 40 away from the upper end of the guide tube 28 and the area of the circulation port 18, and toward the area of the bypass port 20.

Where the shearable plug 22 is present, a further increase in hydraulic pressure above the tool body 14 can selectively cause the shear pin 24 to shear, allowing the shearable plug 22 to be forced out of the bypass port 20, as shown in FIG. 4. Where the shearable plug 22 is not used, the bypass port 20 is already open. In this configuration, any material, whether fluid or debris or equipment, which passes through the inlet port 40 will be allowed to pass through the bypass port 20, as shown by the arrows, depending of course on the size of any solid particles or equipment. This bypassing movement of the material through the tool body 14 is aided by the diversion caused by the baffle 30. Therefore, fluid and equipment can be passed through the tool body 14 after the pumpdown plug PP is captured and concealed.

While the particular invention as herein shown and disclosed in detail is fully capable of obtaining the objects and providing the advantages hereinbefore stated, it is to be understood that this disclosure is merely illustrative of the presently preferred embodiments of the invention and that no limitations are intended other than as described in the appended claims.

We claim:

1. A device for capturing a pump down plug, comprising:
- a tubular housing positionable in a well bore;
- an inlet port into said housing;
- a tool body slidably mountable within said housing downstream from said inlet port, said tool body being releasably mountable at a first longitudinal position within said tubular housing;
- a tool body retention device at a second longitudinal position within said tubular housing below said first position;
- a circulation port through said tool body;
- a bypass port through said tool body; and
- a plug guide adapted to conduct a pumpdown plug from said inlet port to said circulation port only when said tool body is in said first position.

2. The device recited in claim 1, further comprising a material diverter on said plug guide, said material diverter being selectively positionable to divert movement of material away from said plug guide and toward said bypass port when said tool body is in said second position.

3. The device recited in claim 2, wherein said material diverter comprises a pivotable baffle.

4. The device recited in claim 1, wherein said inlet port comprises an outlet of a tubular element positioned above said tubular housing.

5. The device recited in claim 4, wherein said tubular element is selectively alignable with said plug guide.

6. The device recited in claim 1, further comprising a releasable attachment between said tool body and said tubular housing.

7. The device recited in claim 6, wherein said releasable attachment comprises a shear pin.

8. The device recited in claim 1, wherein said plug guide comprises a tubular receptacle above said circulation port.

9. The device recited in claim 1, further comprising a releasable closure in said bypass port.

10. The device recited in claim 9, wherein said releasable closure in said bypass port comprises a shearable plug.

11. The device recited in claim 1, wherein said tool body retention device at said second position comprises an internal shoulder within said tubular housing.

12. A method for capturing a pump down plug, comprising:

providing a sliding tool body releasably attached at a first longitudinal position within a housing, said tool body having an open circulation port and a bypass port;

positioning said tool body to receive a pump down plug from a housing inlet;

guiding said released pump down plug from said housing inlet to said circulation port, thereby closing said circulation port;

increasing fluid pressure above said tool body, to slide said tool body longitudinally to a second position, thereby allowing material from said housing inlet to flow toward said bypass port.

13. The method recited in claim 12, further comprising increasing fluid pressure to release a closure from said bypass port, thereby opening said bypass port.

14. The method recited in claim 12, further comprising shifting a material diverter after said release of said tool body from said first position, to thereby divert material away from said circulation port and toward said bypass port.

* * * * *